US006009882A

United States Patent [19]

Schine et al.

[11] Patent Number: 6,009,882

[45] Date of Patent: Jan. 4, 2000

[54] METHOD AND APPARATUS FOR BRAIDING HAIR

[75] Inventors: Nina Schine, DeWitt; Anita Vibbert, Syracuse, both of N.Y.

[73] Assignee: Heavenly Hair Accessories, Inc., E. Syracuse, N.Y.

[21] Appl. No.: 09/209,112

[22] Filed: Dec. 10, 1998

[51] Int. Cl.[7] ..... A45D 24/00

[52] U.S. Cl. ..... 132/200; 132/210; 132/273

[58] Field of Search ..... 132/201, 200, 132/275, 210, 222, 246, 247, 248, 273, 274; D28/39, 40, 41, 42, 43

[56] References Cited

U.S. PATENT DOCUMENTS

| | | | |
|---|---|---|---|
| D. 391,672 | 3/1998 | Nahoum | D28/41 |
| 1,393,448 | 10/1921 | Kietz | 132/248 |
| 3,099,271 | 7/1963 | Dubelier | 132/212 |
| 3,751,769 | 8/1973 | Reiner | 132/273 |
| 5,167,245 | 12/1992 | Harriett | 132/273 |
| 5,289,834 | 3/1994 | Lawrence | 132/273 |
| 5,465,741 | 11/1995 | Dvorak | 132/275 |
| 5,497,795 | 3/1996 | Hibbard | 132/200 |
| 5,669,399 | 9/1997 | Camp, Jr. et al. | 132/273 |
| 5,778,904 | 7/1998 | Elsner | 132/275 |

*Primary Examiner*—Gene Mancene
*Assistant Examiner*—Pedro Philogene
*Attorney, Agent, or Firm*—George R. McGuire

[57] ABSTRACT

A method and device for braiding hair. The device includes an elongated, non-elastic cord that is folded about its midpoint to form first and second, essentially equal length halves. A plurality of fasteners are slidingly positioned, in predetermined, spaced intervals along the length of the first and second halves. A series of looped openings are formed in between adjacently positioned fasteners and the cord's midpoint and the fastener positioned adjacent thereto. Hair may be braided by sequentially passing strands of hair through the sequentially positioned loops and sliding the adjacently positioned fasteners into secure, engaging relation with the strands.

4 Claims, 6 Drawing Sheets

METHOD AND APPARATUS FOR BRAIDING HAIR

BACKGROUND OF THE INVENTION

The present invention generally relates to a method and apparatus for braiding hair, and more particularly to a specific method of braiding hair using an ornamental and functional apparatus to assist in the braiding process.

Braiding one's hair involves the overlapping, twisting, and weaving of at least two strands of hair in order to achieve a desired hair style. Typically, the hair being braided extends downwardly along the back of one's head. Therefore, a person braiding her own hair cannot see herself directly perform the braiding, but, at best, can see the reverse image in a mirror. Accordingly, a fanciful type of braid is difficult to accurately prepare by oneself.

In response to the perceived difficulty in braiding or retaining a strand of one's hair, a variety of devices have been developed. Several devices have been developed to assist a person in simply retaining her hair in a desired configuration. Examples of such devices can be readily seen in U.S. Pat. Nos. 5,499,638 to Ripely; 602,699 to Davis; and 5,271,421 to Videtzky. Devices for holding hair specifically in a pony-tail configuration (a single strand of hair) can be seen in U.S. Pat. Nos. 5,289,834 to Lawrence; 5,036,870 to Edmark; and 5,167,245 to Harriett. Other devices have been developed to hold a strand of hair in a wrap, examples of such being disclosed in U.S. Pat. Nos. 4,892,110 to Harrie; and 5,465,741 to Dvorck. Some other devices have been designed specifically for forming a multi-strand braid, several examples of which are described in U.S. Pat. Nos. 5,497,795 to Hibbard; 5,454,385 to George; 5,544,666 to Schach; 5,564,445 to Query; and 5,669,399 to Camp, Jr. et al.

It is a principal object and advantage of the present invention to provide a versatile hair braiding device that may be used by people having varying styles of hair.

It is another object and advantage of the present invention to provide a hair braiding device having a variety of interchangeable ornamental elements.

It is a further object and advantage of the present invention to provide a hair braiding device that is easy to use.

Other objects and advantages of the present invention will, in part, be obvious, and, in part, appear hereinafter.

SUMMARY OF THE INVENTION

In accordance with the foregoing objects and advantages, the present invention provides a method and apparatus for braiding hair using a braiding device generally comprised of a flexible cord and a plurality of fastening elements slidably positioned on the cord. Each end of the cord passes through separate, laterally spaced, parallel extending openings (or one enlarged opening) formed through each of the fasteners, with the cord being divided into two essentially equal halves. The fasteners are spaced at predetermined intervals along the length of the cord, thereby forming a series of loops defined in between adjacently positioned fasteners and with the uppermost fastener causing a closed loop to be formed at the midpoint of the cord.

In use, an individual takes a strand of hair from the central portion of the head and pulls it downwardly through the closed loop formed at the midpoint of the cord. The uppermost fastener is then slid upwardly to tightly clamp the hair strand within the loop. Strands on each side of the head (above the ears), are pulled through the next, lower loop in series and joined together with the beginning strand. The cord is then twisted one revolution (or crisscrossed) in order to separate the loop into two smaller openings, with the collective strands being positioned through the upper opening. The strand is then drawn through the lower opening formed through the twisted loop. The fastening element adjacently positioned to the loop is then slid upwardly to tightly secure the strand in the loop.

An additional strand of hair from each side of the head, adjacent to the previously braided strands, are then joined with the braided strand, pulled through the next lowest loop, and joined together. The loop is then twisted one revolution in order to separate the loop into two smaller openings, with the strands being positioned through the upper opening. The strand is then pulled through the lower opening and the adjacent fastener is slid upwardly to tightly secure the strand in position.

This process of taking additional strands from the side of the head, joining them with the already braided strand, and pulling them through successive loops is continued until the braid is complete.

The fasteners can take the form of an ornamental, cube-shaped bead having an enlarged opening bored through two opposing sides thereof, or a button having two laterally spaced openings formed therethrough, or a disk having two channels formed on one surface thereof in parallel, spaced relation to one another. Other fastening elements capable of sliding along the length of cord could also be used.

BRIEF DESCRIPTION OF THE DRAWINGS

The present invention will be further described in the following Detailed Description which is intended to be read in conjunction with the drawing figures, wherein.

DETAILED DESCRIPTION

Figure 1:
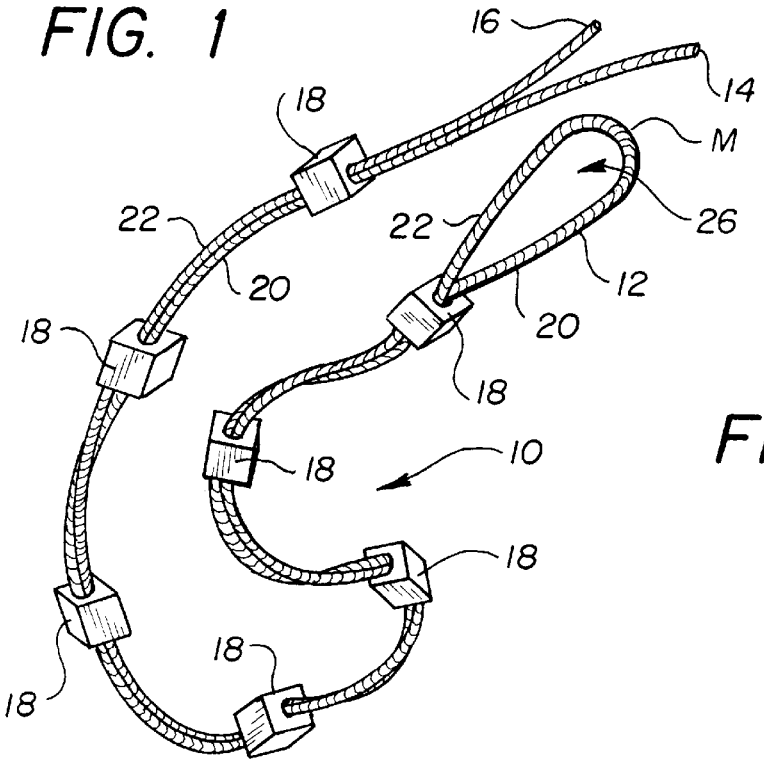
FIG. 1 is a perspective view of a preferred embodiment of the apparatus of the present invention.

Referring now to the drawings, wherein like reference numerals refer to like parts throughout, there is seen in FIG. 1 a hair braiding device, denoted generally by reference numeral 10, of predetermined length (e.g., 24 inches). Hair braiding device 10 is essentially comprised of an elongated, flexible, non-elastic cord 12 having opposite, first and second ends 14 and 16, respectively, and a plurality of fasteners 18 slidingly positioned on cord 12. The non-elastic quality of cord 12 ensures that device 10 will securely retain hair in a braid, and will not come loose as a result of losing its elasticity, while its flexible nature permits it to be easily worked with. When assembled, cord 12 is folded about its midpoint, M, into first and second, essentially equal halves 20 and 22, respectively.

Figure 1A:
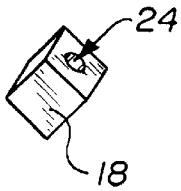
FIG. 1A is a perspective view of a cube-shaped fastener used on the present invention.

In a preferred embodiment, fastener 18 is comprised of a cube-shaped bead having an opening 24 formed through two opposite surfaces thereof (see FIG. 1A). Opening 24 is of a large enough diameter to accommodate both cord halves 20 and 22 simultaneously passing therethrough. To maintain cord 12 in its folded state, ends 14 and 16 are each passed through opening 24 of each fastener 18. Fasteners 18 are then spaced at predetermined intervals (e.g., 3 inches) along the length of cord halves 20 and 22, thereby forming a plurality of loops 26 positioned in series. Although ends 14 and 16 and cord halves 20 and 22 pass through opening 24 tightly enough to ensure that fasteners 18 do not freely slide along, and, perhaps, fall off of cord 12, fasteners 18 may still be easily slid along the cord's length. Accordingly, by sliding a fastener 18 along cord 12, the size of the loops 26 positioned adjacent to that fastener will vary proportionally.

Figures 11, 12:
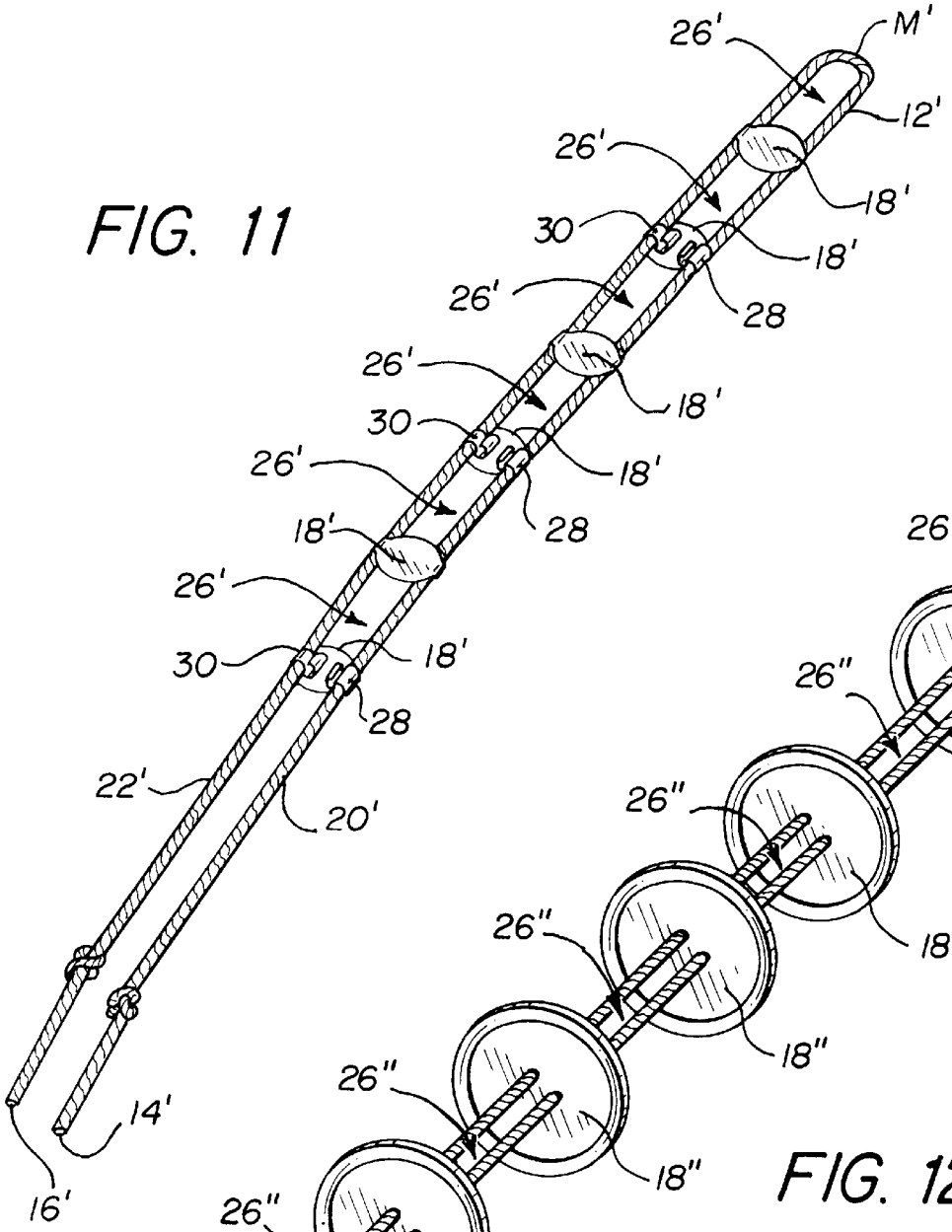
FIG. 11 is a perspective view of a second embodiment of an apparatus of the present invention.
FIG. 12 is a perspective view of a third embodiment of an apparatus of the present invention.

As seen in FIGS. 11–12, fasteners 18 may be comprised of objects other than beads. In FIG. 11 fastener 18' is comprised of a planar disk having first and second clasps 28 and 30, respectively, formed on one surface thereof which define channels extending in spaced, parallel relation to one another. With reference to FIG. 12, fastener 18" is shown in a second alternate embodiment in the form of a button. Ends 14" and 16" pass through respective, laterally spaced holes formed through button 18", dividing cord 12' into two equal halves 20" and 22". In addition to beads, disks and buttons, other types of decorative objects could also serve as a sliding fastener.

Figure 2:
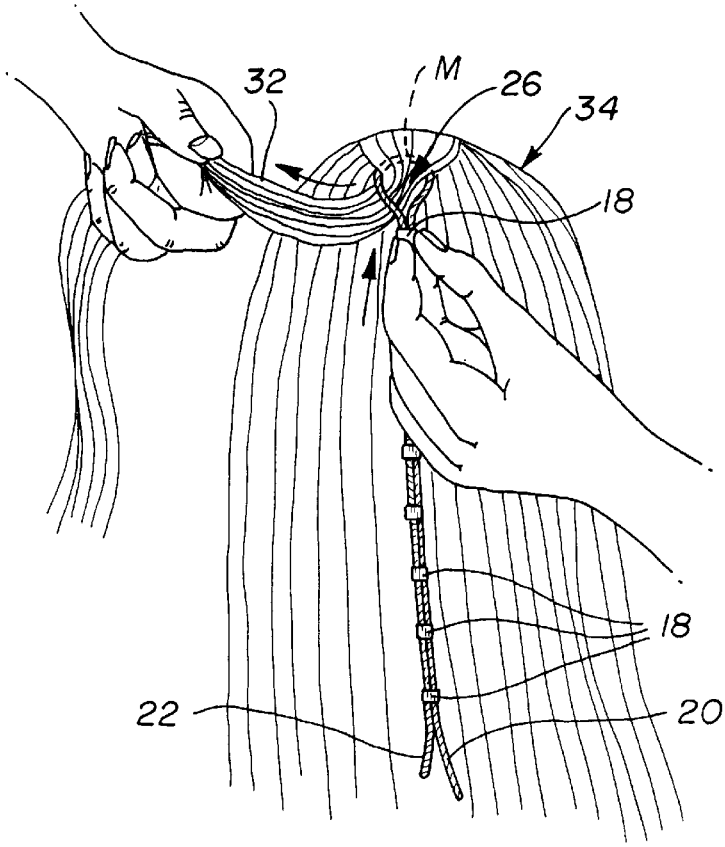
FIGS. 2–10 are each rear elevational views of an individual's head illustratively showing, in sequential order, the method of using the present invention to braid one's hair.

Referring now to FIGS. 2–10, the method of using braiding device 10 is illustratively shown. The first step in using braiding device 10, as shown in FIG. 2, is to take a strand of hair 32 from the central portion of head 34 and pull it through the loop 26 formed at the midpoint, M, of cord 12. The uppermost fastener 18 may then be slid upwardly along cord halves 20 and 22 until strand 32 is tightly secured within loop 26.

Figure 3:
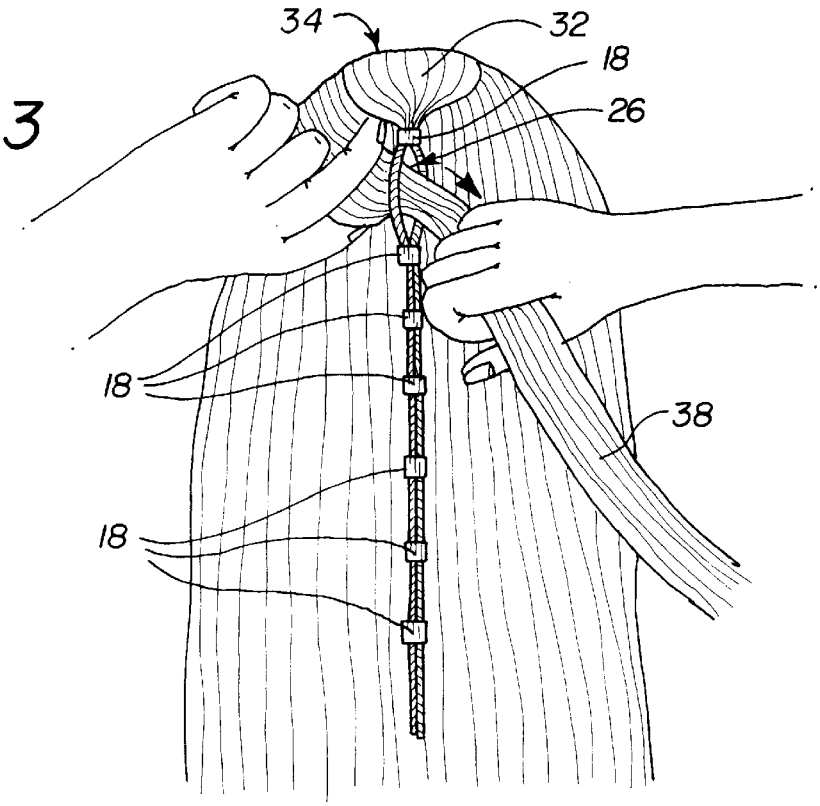
Figure 4:
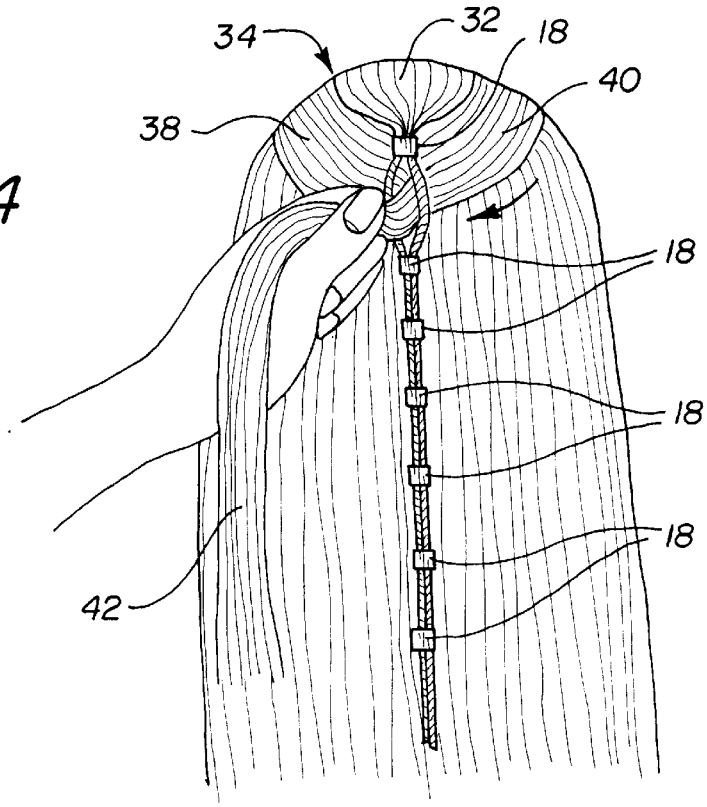

The second step in using braiding device 12, as shown in FIGS. 3–4, is to take a strand 38 and 40 from each side of the head, preferably above the ears, pull them through the loop 26 positioned adjacently below the uppermost loop 26, and join them together along with strand 32, thereby forming a new, single strand 42.

Figure 5:
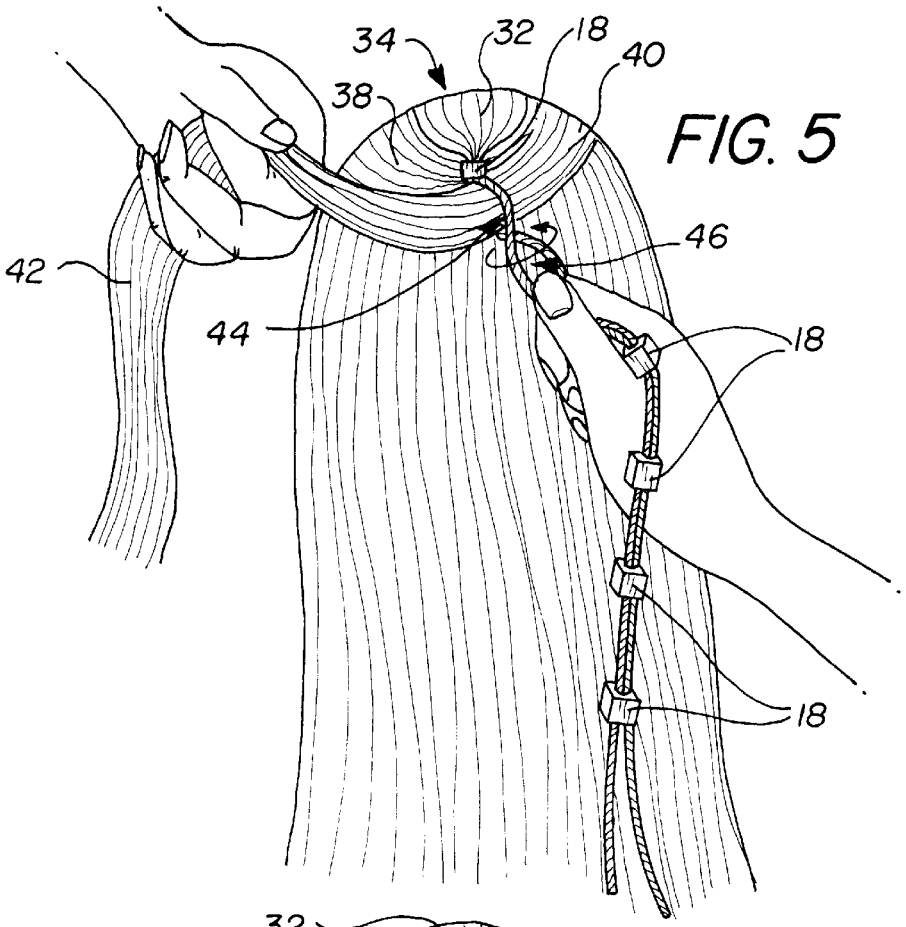
Figure 6:
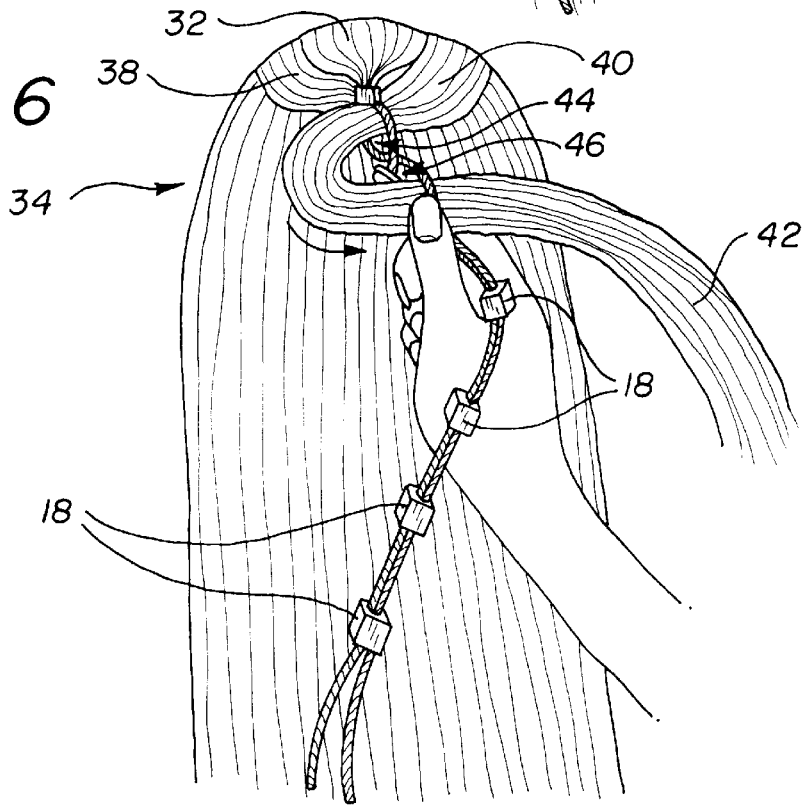
Figure 7:
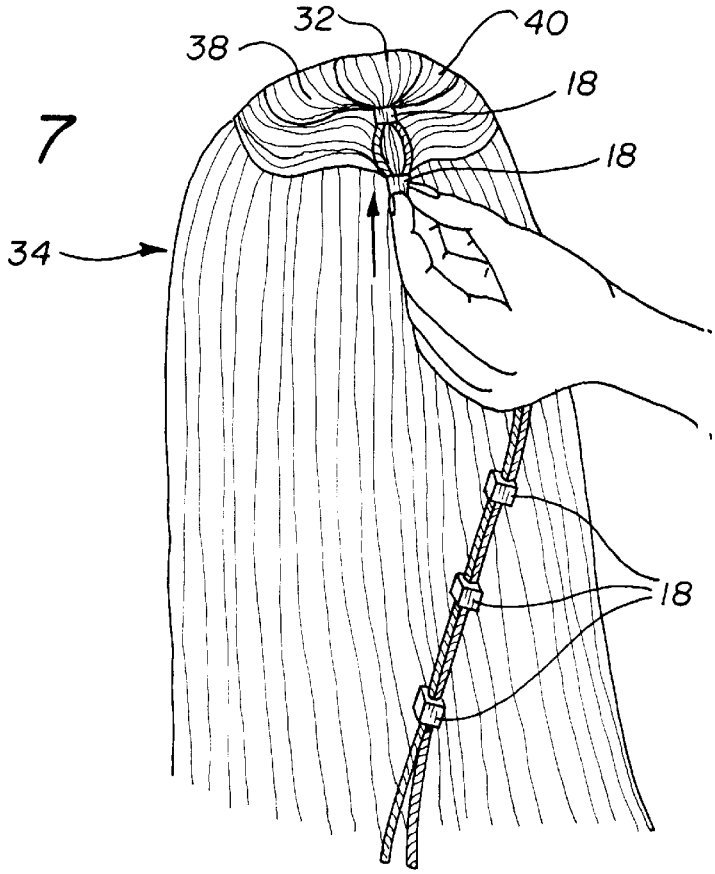

Strand 42 should be pulled taut and then, as is shown in FIG. 5, the loop 26 through which strand 42 extends is twisted one revolution in order to separate the loop into two smaller loops 44 and 46, with strand 42 being positioned through upper loop 44. Strand 42 may then be pulled through lower loop 46, as is shown in FIG. 6. The fastener 18, positioned adjacent lower loop 46 may then be slid upwardly along cord halves 20 and 22 until strand 42 is tightly secured within loops 44 and 46, as is shown in FIG. 7.

Figure 8:
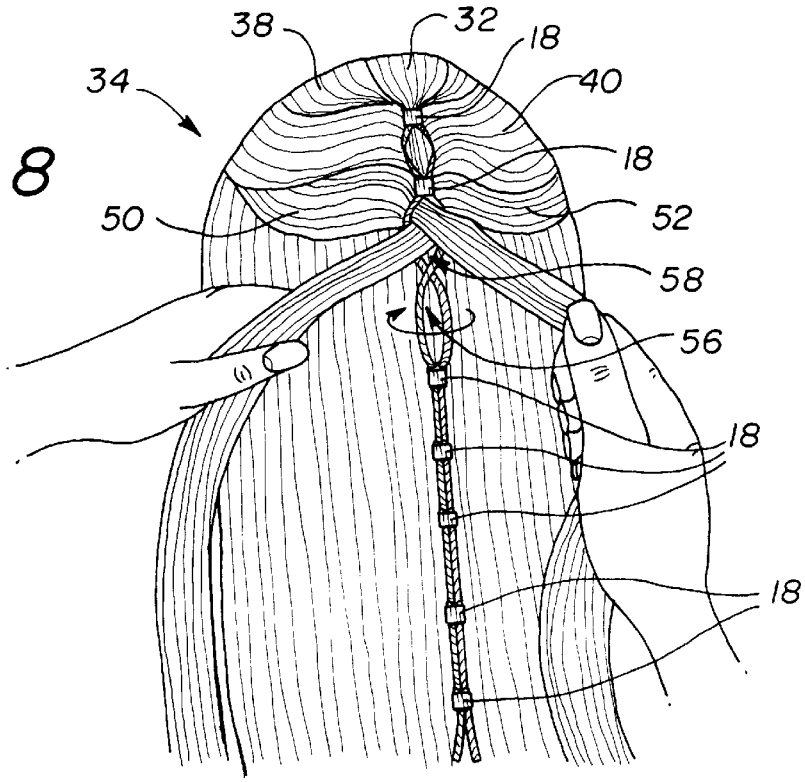
Figure 9:
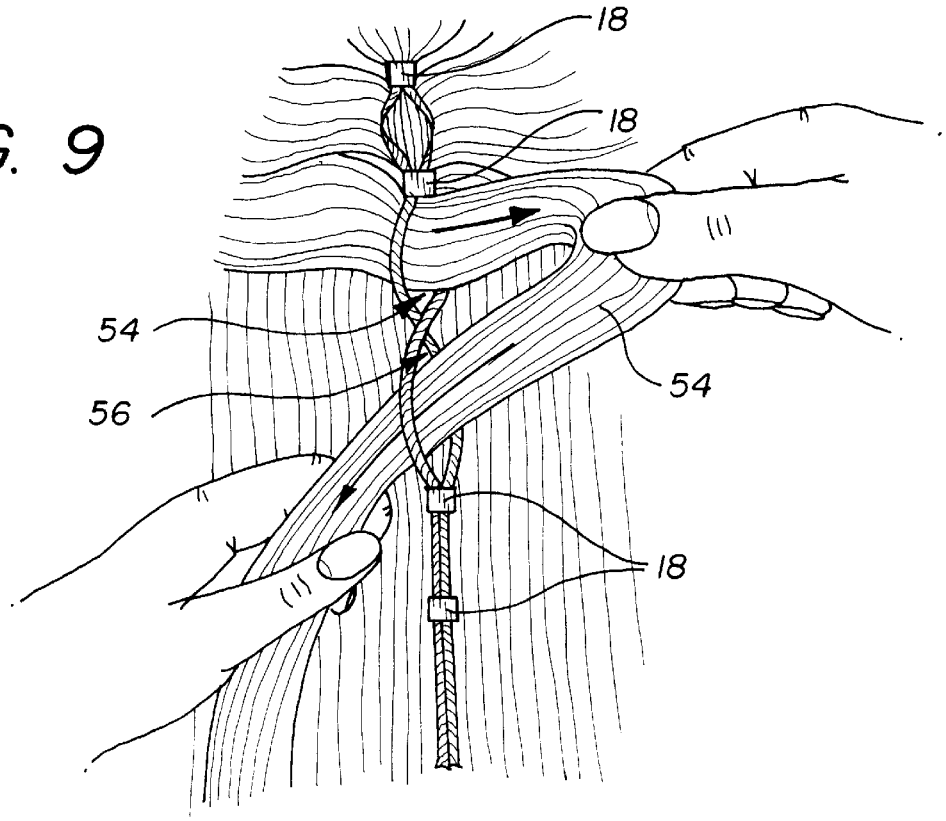

Referring now to FIG. 8, two new strands of hair 50 and 52 are gathered from the sides of head 34, adjacently beneath strands 38 and 40, and are pulled through the next loop 26 at which they are joined together along with strand 42, thereby forming a new strand 54 (see FIG. 9). Loop 26 is twisted one revolution to form two smaller loops 56 and 58, with strand 54 extending through upper loop 56. Strand 54 is then passed through lower loop 56 and the fastener 18 positioned adjacent to loop 56 is slid upwardly to tightly secure strand 54 within loops 54 and 56.

Figure 10:
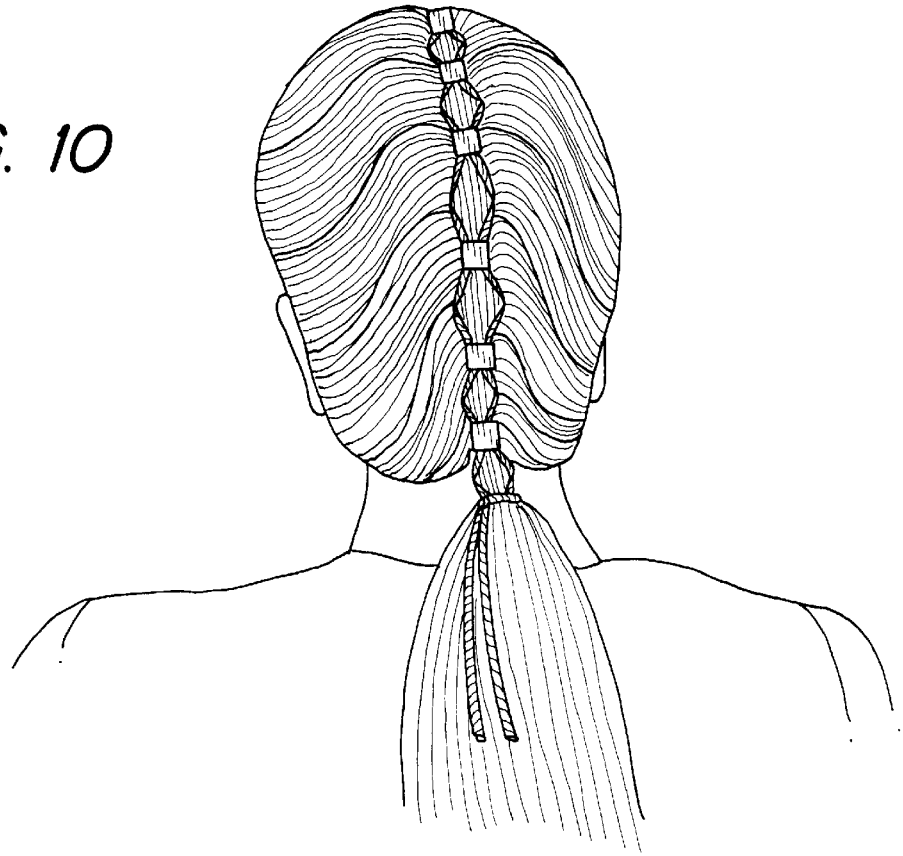

This process of taking strands from each side of the head, passing them through the next loop 26 in series and joining them with the previously braided strand continues until the hair is completely braided. The end result of the braiding process is illustrated in FIG. 10, with the ends of cord 12 being tied off around the braid in order to ensure that the trading end of the braid remains gathered.

Although a preferred mode of practicing the present invention has been disclosed, the scope of the patent should not be limited thereby, but should extend to its fill spirit as defined by the following claims.

What is claimed is:

1. A method of braiding hair with the use of a braiding device having an elongated, non-flexible cord that is folded about its midpoint into first and second, essentially equal length halves by a plurality of fasteners slidingly positioned along the lengths of said first and second halves, said method comprising the steps of:

a) defining a plurality of loops through which strands of said hair may be passed by positioning said fasteners in predetermined, spaced intervals along the lengths of said first and second halves, whereby a series of loops will be formed in between adjacently positioned fasteners and with the first loop formed in between said midpoint and the fastener positioned adjacent thereto;

b) gathering a first strand of hair and passing it through said first loop;

c) sliding said fastener positioned adjacent to said midpoint into securely engaging relation with said first strand;

d) gathering second and third strands of hair, one from each side of said first strand, and passing them through the second of said loops in series after said first loop;

e) criss-crossing the portions of said first and second halves defining said second loop in order to divide said second loop into first and second openings, with said second and third strands being positioned through said first opening;

f) joining said second and third strands with said first strand to form a single, fourth strand, and passing said fourth strand through said second opening;

g) sliding the fastener positioned adjacent said second opening into secure, engaging relation with said fourth strand of hair; and h) repeating steps d)–g) until said hair is fully braided.

2. The method according to claim 1, wherein said plurality of fasteners are cube-shaped beads.

3. The method according to claim 2, wherein said plurality of fasteners are buttons.

4. The method according to claim 1, wherein said plurality of fasteners are discs.

* * * * *